US008813511B2

(12) United States Patent
Kopko et al.

(10) Patent No.: US 8,813,511 B2
(45) Date of Patent: Aug. 26, 2014

(54) CONTROL SYSTEM FOR OPERATING CONDENSER FANS

(75) Inventors: William L. Kopko, Jacobus, PA (US); Jose Ruel Yalung de la Cruz, Lacey, WA (US); Israel Federman, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 1014 days.

(21) Appl. No.: 12/751,475

(22) Filed: Mar. 31, 2010

(65) Prior Publication Data

US 2011/0083454 A1 Apr. 14, 2011

Related U.S. Application Data

(60) Provisional application No. 61/165,356, filed on Mar. 31, 2009.

(51) Int. Cl.
*F25D 17/04* (2006.01)

(52) U.S. Cl.
USPC ..... 62/181; 62/183; 62/186

(58) Field of Classification Search
USPC ..... 62/181, 183, 186
See application file for complete search history.

(56) References Cited

U.S. PATENT DOCUMENTS

| | | | | |
|---|---|---|---|---|
| 2,945,356 | A * | 7/1960 | Schultz et al. | 62/157 |
| 3,613,391 | A | 10/1971 | Harter | |
| 4,120,173 | A | 10/1978 | Kimpel | |
| 4,517,812 | A | 5/1985 | Umezu | |
| 5,036,676 | A | 8/1991 | Dudley | |
| 5,099,654 | A | 3/1992 | Baruschke et al. | |
| 5,138,844 | A | 8/1992 | Clanin et al. | |
| 5,144,812 | A | 9/1992 | Mills, Jr. et al. | |
| 5,150,581 | A | 9/1992 | Smith | |
| 5,230,223 | A | 7/1993 | Hullar et al. | |
| 5,333,469 | A | 8/1994 | Hullar et al. | |
| 5,823,004 | A | 10/1998 | Polley et al. | |
| 6,047,557 | A | 4/2000 | Pham et al. | |

(Continued)

FOREIGN PATENT DOCUMENTS

| | | | |
|---|---|---|---|
| EP | 0342928 | A2 | 11/1989 |
| EP | 1985938 | A1 | 10/2008 |
| JP | 2557254 | | 11/1989 |
| WO | 2009029506 | A1 | 3/2009 |

OTHER PUBLICATIONS

International Search Report. PCT/US2010/029400 mailed Dec. 22, 2010.

(Continued)

*Primary Examiner* — Cheryl J Tyler
*Assistant Examiner* — Jonathan Bradford
(74) *Attorney, Agent, or Firm* — Fletcher Yoder, P.C.

(57) ABSTRACT

Methods and systems for controlling the operation of condenser fans are provided. At most discharge pressures, the operation of the condenser fans may be controlled based on a capacity of the compressor system. To adjust operation of the condenser fans, the speed of the fans and/or the number or operational fans may be adjusted. The control of the condenser fans based on compressor system capacity may be overridden at compressor discharge pressures that rise above a high pressure level and fall below a low pressure level. At the high and low discharge pressures, the fan speed and/or number of operating fans may be adjusted based solely on the discharge pressure rather than on the compressor system capacity.

19 Claims, 8 Drawing Sheets

(56) References Cited

U.S. PATENT DOCUMENTS

| | | | | |
|---|---|---|---|---|
| 6,202,430 | B1 | 3/2001 | Karl | |
| 6,257,007 | B1 | 7/2001 | Hartman | |
| 6,418,738 | B1 | 7/2002 | Yamashita | |
| 6,427,460 | B1 * | 8/2002 | Zanon | 62/174 |
| 6,530,236 | B2 | 3/2003 | Crane et al. | |
| 6,637,229 | B1 | 10/2003 | Forrest et al. | |
| 7,246,500 | B2 | 7/2007 | Singh et al. | |
| 7,743,617 | B2 | 6/2010 | Crane et al. | |
| 8,051,688 | B2 * | 11/2011 | Soma | 70/162 |
| 2006/0112703 | A1 | 6/2006 | Singh et al. | |
| 2008/0110610 | A1 | 5/2008 | Lifson et al. | |

OTHER PUBLICATIONS

Office Action for Korean application No. 10-2011-7025976, dated Jul. 3, 2013, pp. 1-8.

Office Action for Chinese Application No. 2010800113476 issued Nov. 4, 2013.

* cited by examiner

FIG. 2
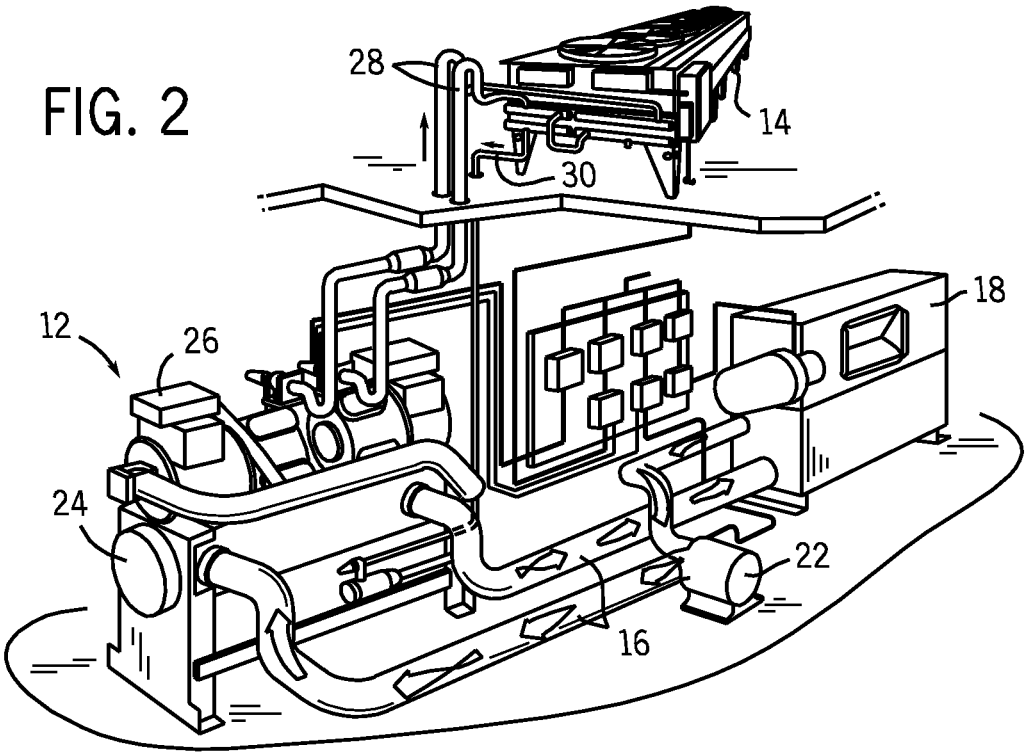
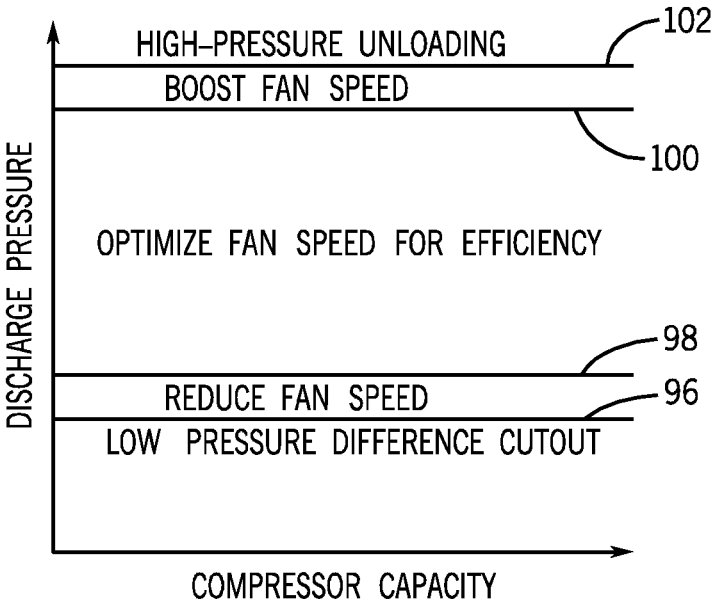
FIG. 9

CONTROL SYSTEM FOR OPERATING CONDENSER FANS

CROSS REFERENCE TO RELATED APPLICATIONS

This application claims priority from and the benefit of U.S. Provisional Application Ser. No. 61/165,356, entitled "Control System for Operating Condenser Fans," filed Mar. 31, 2009, which is hereby incorporated by reference.

BACKGROUND

The invention relates generally to a control system for operating condenser fans.

Certain refrigeration and air conditioning systems generally rely on a chiller to reduce the temperature of a process fluid, such as water, to produce chilled process fluid. Air may pass over the chilled process fluid in an air handler and circulate throughout a building or other application to be cooled. In typical chillers, the process fluid is cooled by an evaporator that absorbs heat from the process fluid by evaporating refrigerant within the evaporator. The refrigerant may then be compressed in a compressor and transferred to a condenser, such as an air cooled condenser. In an air cooled condenser, the refrigerant is cooled by air and condensed into a liquid. Air cooled condensers typically include a condenser coil and a fan that induces airflow over the coil. The amount of airflow over the coil may be varied by either adjusting the speed of the fan, or in multiple fan configurations, by staging the fans. Staging involves selectively operating fans associated with certain condenser coils. A combination of staging and varying fan speed may also be employed.

The amount of airflow over the condenser coils affects chiller efficiency. If the airflow is too high, the power necessary to create this excess flow represents wasted energy. If the airflow is too low, the compressor may have to expend extra energy to provide sufficient cooling. Prior attempts have been made to optimize airflow over condenser coils. For example, some chillers compute desired airflow based on ambient temperature. However, optimal airflow is independent of ambient temperature. Therefore, chillers that implement airflow control based on this parameter may not be operating at maximum efficiency. Similarly, chillers that adjust airflow based on condenser pressure also may operate at reduced efficiency. Running a chiller at lower efficiency results in higher operating costs.

SUMMARY

The present disclosure relates to a refrigeration system that includes a variable capacity compressor system configured to compress refrigerant, a condenser configured to receive and to condense the compressed refrigerant, an expansion device configured to expand the condensed refrigerant, an evaporator configured to evaporate the expanded refrigerant prior to returning the refrigerant to the variable capacity compressor system, one or more fans driven by a fan drive and configured to displace air over the condenser, a means for determining a discharge pressure of the variable capacity compressor system, and a controller operatively coupled to the fan drive. The controller is configured to regulate the fan drive based on an operational capacity of the variable capacity compressor system when the discharge pressure is within a predetermined range and to regulate the fan drive based on the discharge pressure when the discharge pressure is outside of the predetermined range.

The present disclosure also relates to a refrigeration system that includes a variable capacity compressor system of one or more variable speed compressors configured to compress refrigerant, a condenser configured to receive and to condense the compressed refrigerant, an expansion device configured to expand the condensed refrigerant, an evaporator configured to evaporate the expanded refrigerant prior to returning the refrigerant to the variable capacity compressor system, one or more fans driven by a fan drive and configured to displace air over the condenser, a means for determining a discharge pressure of the variable capacity compressor system, and a controller operatively coupled to the fan drive. The controller is configured to regulate the fan drive based on a rotational speed of the one or more variable speed compressors when the discharge pressure is within a predetermined range and to regulate the fan drive based on the discharge pressure when the discharge pressure is outside of the predetermined range.

The present invention further relates to a method of operating a refrigeration system. The method includes determining an operational capacity of a compressor system, determining a discharge pressure of the compressor system, controlling operation of one or more condenser fans based on the operational capacity when the discharge pressure is within a predetermined range, and controlling operation of the one or more condenser fans based on the discharge pressure when the discharge pressure is outside of the predetermined range.

DRAWINGS

FIG. 2 is a perspective view of the air cooled refrigeration system shown in FIG. 1.

FIG. 9 is a graph of discharge pressure verses compressor capacity.

DETAILED DESCRIPTION

Figure 1:
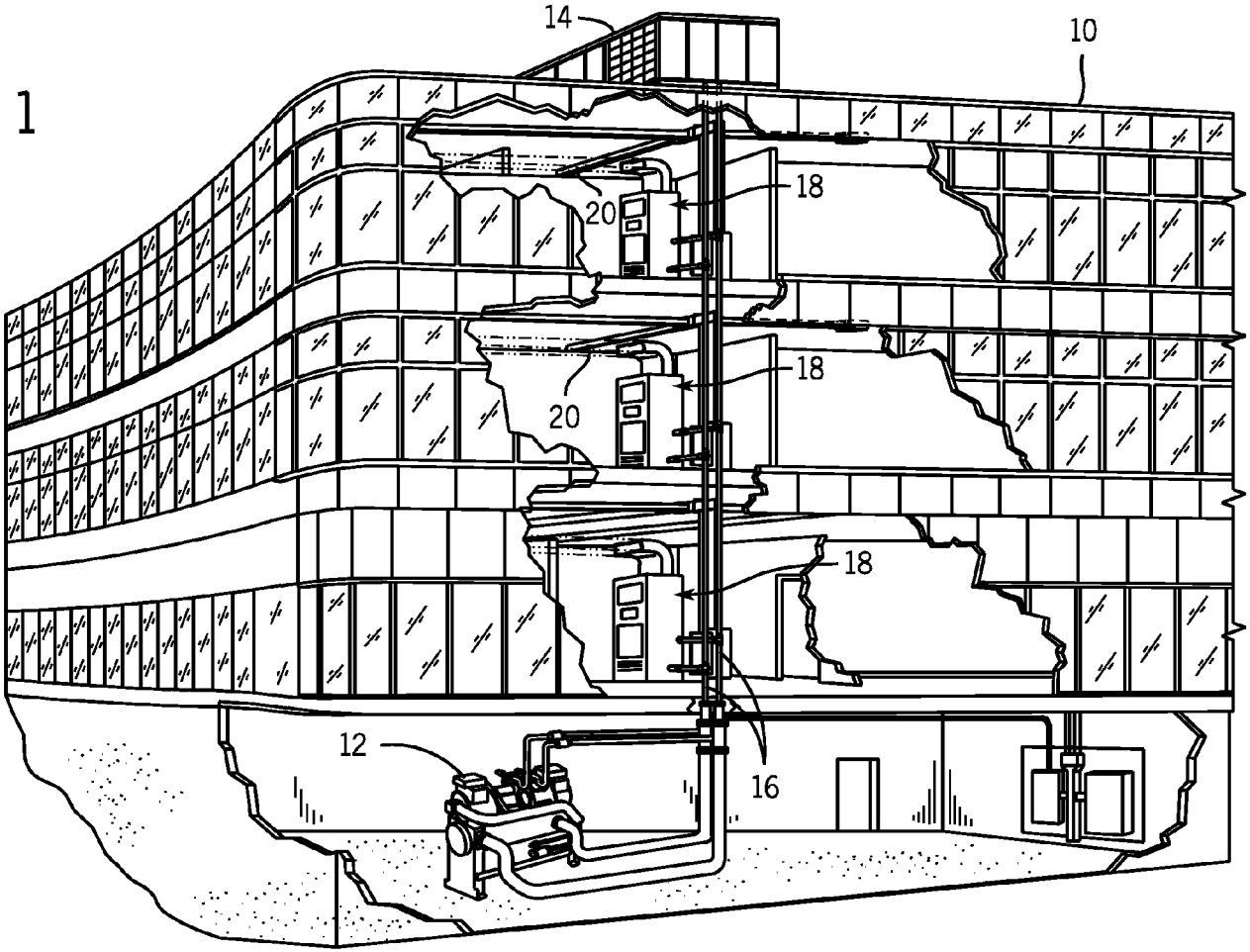
FIG. 1 is an illustration of an embodiment of a commercial HVAC system that employs an air cooled refrigeration system.

The present disclosure is directed to techniques for controlling operation of condenser fans within refrigeration systems. According to certain embodiments, the operation of the condenser fans may be controlled based on the current capacity of the compressor system. As used herein, the term "capacity" refers to the total operational displacement rate of refrigerant within a compressor system that may include one or more compressors. A controller may set the operating capacity of the compressor system at a level designed to meet the cooling needs of the refrigeration system. For example, in certain embodiments, a controller may determine the operating capacity based on factors such as the chilled water temperature, the air temperature of the cooled environment, and/or the compressor suction pressure, among others. The controller may then adjust operation of the compressor system so that the compressor system operates at the determined capacity. For example, in a system employing variable speed compressors, the controller may vary the rotational speed of the compressors to adjust the operating capacity of the compressor system. In a system employing constant speed compressors that are staged, the controller may disable or enable different numbers of compressors to adjust the operating capacity of the compressor system.

In addition to setting the compressor system to operate at the determined capacity, the controller also may adjust operation of the condenser fans based on parameters of the determined compressor system operating capacity. For example, to set the compressor system to the desired operating capacity, the controller may determine the desired rotational speed of the compressors and/or the number of compressors that should be operational. The controller may then increase or decrease the airflow through the compressor based on the desired compressor rotational speed of the compressors and/or the desired number of operational compressors. For example, the controller may vary the condenser fan speed and/or may enable or disable operation of different numbers of condenser fans to increase or decrease the airflow through the condenser. In other embodiments, rather than using the desired compressor rotational speed or number or operational compressors, the controller may receive an input indicative of the actual compressor speed or of the number of operational compressors (or both) from sensors designed to detect these parameters. Accordingly, rather than employing control mechanisms based on factors such as ambient air temperature or load on the compressor system (including power input and torque), the present disclosure relates to techniques for adjusting operation of the fans based on the compressor system capacity, as determined by the desired or actual number of compressors in operation and/or by the desired or actual rotational speed of the compressors.

Further, the control of the condenser fans based on compressor system capacity may be overridden at compressor discharge pressures that rise above a high pressure level and fall below a low pressure level. At high and low discharge pressures, the fan speed and/or number of operating fans (or both) may be adjusted based solely on the discharge pressure rather than on the compressor system capacity.

FIG. 1 shows an application of a heating, ventilation, and air conditioning (HVAC) system for building environmental management. In this embodiment, a building 10 is cooled by a refrigeration system. The refrigeration system may include a chiller 12 and a condenser 14. As shown, the chiller 12 is located in the basement and the condenser 14 is positioned on the roof. However, the chiller 12 and the condenser 14 may be located in other areas, such as other equipment rooms or areas next to the building 10. The condenser 14 depicted in FIG. 1 is air cooled, i.e., uses outside air to cool refrigerant such that it condenses into a liquid. The chiller 12 may be a stand-alone unit or may be part of a single package unit containing other equipment, such as a blower and/or an integrated air handler. Cold process fluid from the chiller 12 may be circulated through the building 10 by conduits 16. The conduits 16 are routed to air handlers 18, located on individual floors and within sections of the building 10.

The air handlers 18 are coupled to ductwork 20 that is adapted to distribute air between the air handlers. Further, the ductwork 20 may receive air from an outside intake (not shown). The air handlers 18 include heat exchangers that circulate cold process fluid from the chiller 12 to provide cooled air. Fans, included within the air handlers 18, draw air through the heat exchangers and direct the conditioned air to environments within the building 10, such as rooms, apartments, or offices, to maintain the environments at a designated temperature. Other devices maybe included in the system, such as control valves that regulate the flow and pressures of the process fluid and/or temperature transducers or switches that sense the temperatures and pressures of the process fluid, the air, and so forth.

FIG. 2 shows an embodiment of a refrigeration system. As described above with respect to FIG. 1, air is cooled in the air handlers 18 that circulate air over cold process fluid to reduce the building temperature. The cold process fluid is pumped to the air handlers 18 from the chiller 12 by a fluid pump 22. In the chiller 12, the process fluid is cooled in an evaporator 24 that reduces the process fluid temperature by transferring heat to evaporating refrigerant. The refrigerant is then compressed by a compressor system 26 and transferred to the condenser 14 through compressor discharge lines 28. The condenser 14 condenses the refrigerant vapor into a liquid, which then flows through the liquid lines 30 back into the evaporator 24, where the process begins again.

Figure 3:
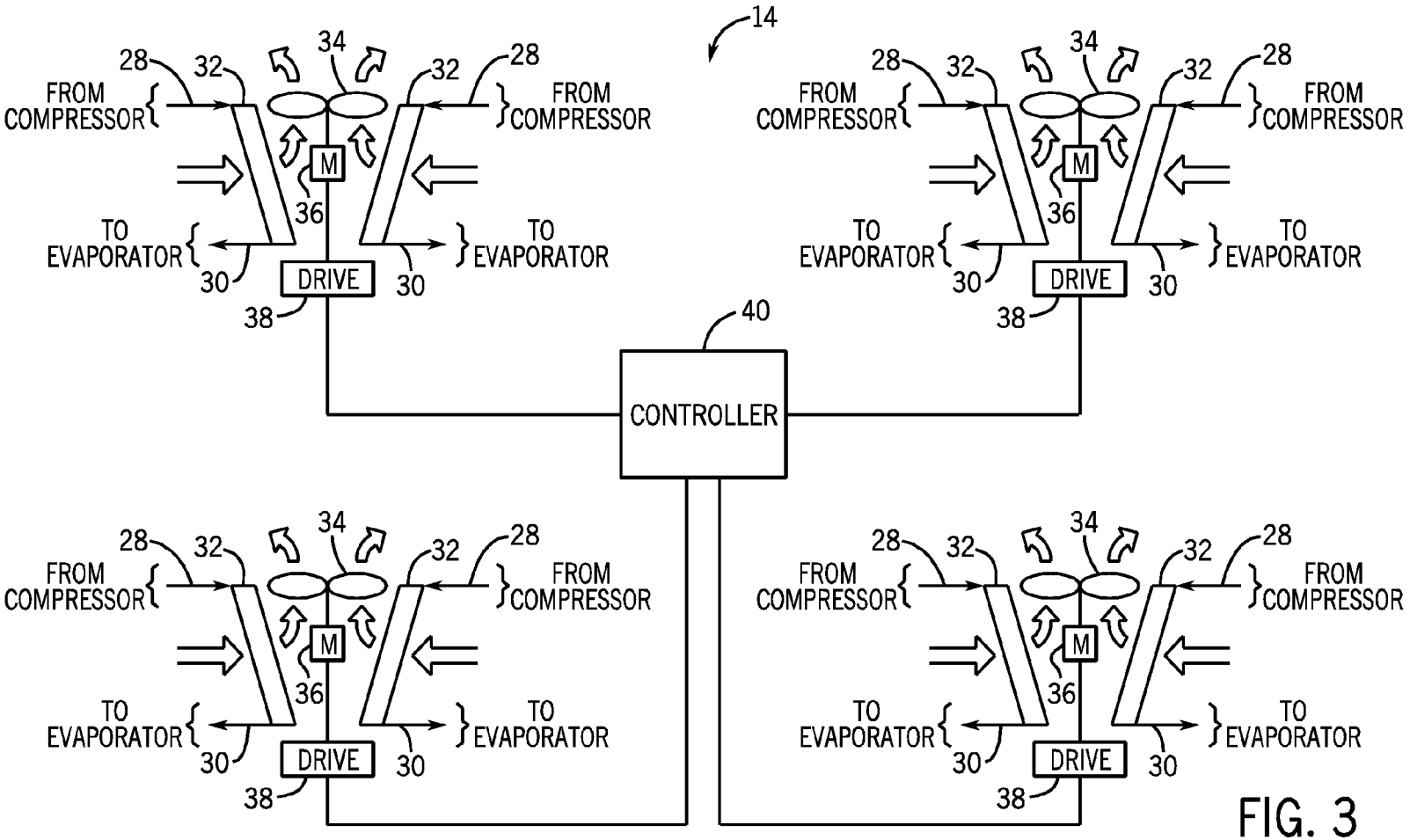
FIG. 3 is a block diagram of a condenser that may be used in the refrigeration system shown in FIGS. 1 and 2.

FIG. 3 is a diagrammatical view of the condenser 14 of the refrigeration system shown in FIG. 2. The condenser 14 presented in this embodiment is air cooled and includes eight condenser coils 32. The number of condenser coils may vary based on the size of the condenser coils 32 and the capacity of the refrigeration system. Higher capacity systems may employ a greater number of larger condenser coils 32, while low capacity systems may use one small coil 32. The condenser coils 32 are typically configured to facilitate heat transfer from refrigerant within the condenser coils 32 to the outside air. The transfer of heat from the refrigerant to the outside air reduces the refrigerant temperature, which generally causes the refrigerant to condense from a vapor into a liquid. The refrigerant typically enters the top of each condenser coil 32 through a compressor discharge line 28 and exits at the bottom of each condenser coil 32 through a liquid line 30.

To further facilitate heat transfer, fans 34 may circulate air through the condenser coils 32. In the present embodiment, each fan 34 includes fan blades and a motor 36. The fan blades are generally designed to provide sufficient airflow through the condenser coils 32 while minimizing the power used to drive the fan blades. The fan blade design generally depends on the application, but may include varying the number of blades and the pitch of each blade. The fan motor 36 may be electrically or mechanically driven. However, typical commercial condensers may employ three-phase alternating current (A/C) electric motors. The performance of the fan motors may be dependent on the number of electromagnetic windings, known as poles. A six or eight pole motor, for example, may provide the most efficient airflow for certain condenser configurations.

In the configuration shown in FIG. 3, each fan 34 circulates air through two condenser coils 32. According to certain embodiments, the condenser coils 32 associated with each fan 34 are angled such that the coils are closer together at the bottom and farther apart at the top near the fan 34. As shown, the angled configuration induces airflow through the side of each condenser coil 32. The air then moves upward through the fan blades and exits the condenser 14, as generally indicated by the arrows. In other embodiments, the configuration of the condenser coils 32 may vary based on the refrigeration system application. For example, other condenser designs may provide one fan 34 for each condenser coil 32 or multiple fans 34 for each condenser coil 32.

In the embodiment depicted in FIG. 3, each fan motor 36 is controlled by a motor drive 38. According to certain embodiments, the motor drives 38 may include motor starters and variable speed drives (VSD). A VSD allows the speed of the fan motor 36 to be continuously varied. For example, if the fan motor 36 is an 8-pole, three-phase, A/C electric motor and the frequency of the supplied electricity is 60 Hz, the fan motor 36 may rotate at 900 revolutions per minute (RPM.) A VSD may vary the frequency of the electricity supplied to the fan motor 36 such that the fan motor 36 may be operated at different speeds. Varying the speed of the fan motor 36 changes the amount of air that flows through the condenser coils 32. Although FIG. 3 shows individual motor drives 38 electrically coupled to each fan motor 36, in other embodiments, where desired, a single drive 38 may be employed and shared between the fan motors. Employing a single motor drive 38 to control each fan motor 36 may reduce construction costs and increase the reliability of the condenser 14. Further, in other embodiments, rather than employing VSDs, motor drives 38 may be employed that operate the fans at a constant speed in a staged configuration. In these embodiments, the amount of airflow through the condenser coils 32 may be varied by adjusting the number of fans that are operational. For example, more fans may be enabled to increase the airflow through the condenser coils 32, while fewer fans may be enabled to decrease the airflow through the condenser coils 32.

The motor drives 38 may use an input signal to engage the fan motors 36 and, in the case of VSDs, specify an operational speed for the fan motors 36. The motor drives 38 may receive the input signals from a controller 40 that is electrically coupled to each motor drive 38. As discussed further below with respect to FIG. 4, the controller 40 may determine the proper fan operation based on the desired or actual compressor system capacity. For example, based on the desired or actual compressor system capacity, the controller 40 may determine the number of fans to operate and/or the operational speed for each fan. The controller 40 may then provide input signals to the motor drives 38 to engage the appropriate fans 34 and/or to operate the fans 34 at the determined operational speed. The fan motors 36 may then rotate the fan blades at the determined speed to induce airflow over the condenser coils 32.

Figure 4:
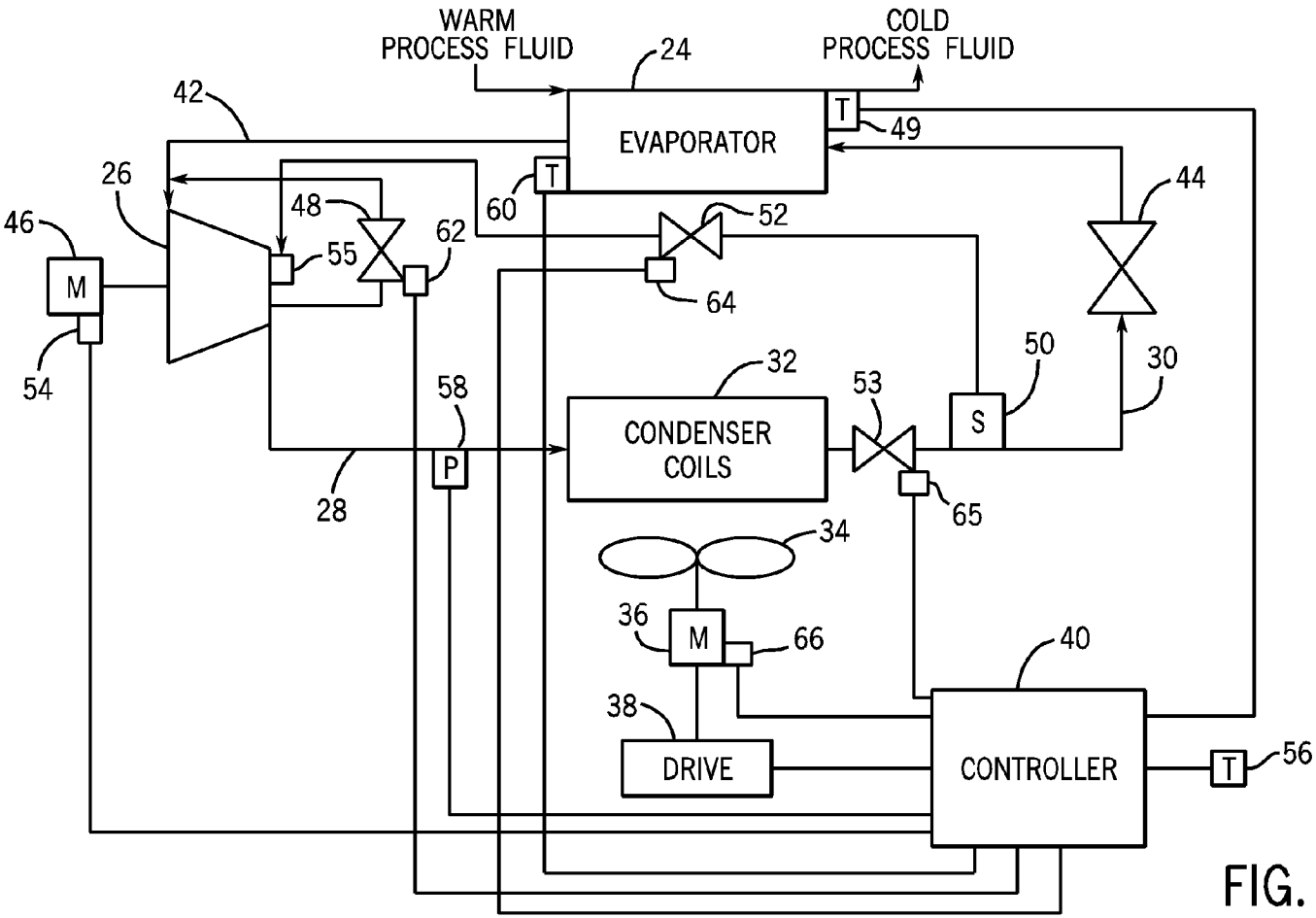
FIG. 4 is a block diagram of an embodiment of the air cooled refrigeration system shown in FIGS. 1 and 2.

FIG. 4 is a schematic diagram of the refrigeration system. As previously discussed with respect to FIGS. 1 and 2, warm process fluid enters the evaporator 24 and is cooled, generating chilled process fluid for the air handlers 18. In cooling the process fluid, refrigerant within the evaporator 24 is vaporized and flows through a suction line 42 into the compressor system 26, which may be representative of one or more compressors. The refrigerant is compressed in the compressor system 26 and exits through the compressor discharge lines 28. The refrigerant then enters the condenser coils 32 where the refrigerant is cooled and condensed to a liquid. From the condenser coils 32, the refrigerant flows through the liquid lines 30 and passes through an expansion valve 44. The expansion valve 44 may be a thermal expansion valve or electronic expansion valve that varies refrigerant flow in response to suction superheat, evaporator liquid level, or other parameters. Alternatively, the expansion valve 44 may be a fixed orifice or capillary tube. The refrigerant exits the expansion valve 44 and enters the evaporator 24, completing the cycle.

Several subsystems are typically employed in modern refrigeration systems to increase efficiency. For example, a compressor system 26 may utilize an unloading subsystem to increase chiller efficiency. According to certain embodiments, an unloading subsystem may include a slide 48 as shown in FIG. 4. The slide valve 48 may be utilized to limit compressor load. When the slide valve 48 is open, refrigerant vapor may be allowed to exit an intermediate stage of the compressor system 26, thereby providing less refrigerant to a high pressure portion of the compressor system 26. The refrigerant vapor exiting at the intermediate stage may flow through the slide valve 48 and reenter the compressor system 26 with the uncompressed refrigerant vapor exiting the evaporator 24. Typically, the slide valve 48 is opened to reduce compressor capacity in response to a low demand on the refrigeration system. For example, during periods of low demand, less refrigerant compression may be required. Through the open slide valve 48, a fraction of the partially compressed refrigerant may escape at the intermediate stage allowing less refrigerant to be compressed in the high pressure portion of the compressor system 26. The reduced compressor capacity may result in lower power consumption by the compressor system 26.

Another subsystem that may increase the efficiency of the refrigeration system is an economizer subsystem. The economizer subsystem includes a flash tank 50, valves 52 and 53, and an economizer port 55 of the compressor system 26. The valve 53 feeds liquid refrigerant from the condenser coils 32 to the flash tank 50. When valve 52 is open, refrigerant vapor from the flash tank 50 flows to the economizer port 55 of the compressor system 26 while the liquid refrigerant from the flash tank 50 is directed through the liquid line 30. The economizer port 55 is connected to an intermediate stage of compressor 26 such that pressure at the economizer port 55 is between the suction pressure (pressure of refrigerant entering the compressor 26) and the discharge pressure (pressure of refrigerant exiting the compressor 26). Through the economizer port 55, flash tank refrigerant vapor, which is at a higher pressure than the refrigerant vapor entering the compressor system 26 from the evaporator 24, may be introduced into the compressor system 26. The compression of the higher pressure refrigerant vapor from the flash tank 50 may increase the efficiency and capacity of the refrigeration system. While economizers are typically used with screw-type compressors, similar configurations may be employed with other compressor configurations, such as reciprocating, scroll, or multistage centrifugal compressors, for example. If an embodiment omits the economizer, liquid refrigerant may flow directly from the condenser coils 32 to the expansion valve 44 via the liquid line 30.

A variety of different compressors, such as centrifugal, scroll, and screw, among others, may be used in the compressor system 26. Regardless of the compressor type, the capacity of the compressor system 26 is typically adjustable. As noted above, the term "capacity" refers to the total operational displacement rate of refrigerant within the compressor system 26. For example, in compressors, such as screw-type compressors, where the rotational speed may be varied, the compressor system capacity may be adjusted by varying the rotational speed of the compressors. As the rotational speed is increased, more refrigerant may be compressed and displaced, thereby increasing the compressor system capacity. Similarly, as the rotational speed is decreased, less refrigerant may be compressed and displaced, thereby decreasing the compressor system capacity. In another example, in compressors, such as scroll-type compressors, that are typically operated at a constant speed, the capacity may be adjusted by staging, i.e., selectively operating a different number of compressors. As more compressors are enabled, more refrigerant may be compressed and displaced in the compressor system, thereby increasing the compressor system capacity. Similarly, as fewer compressors are enabled, less refrigerant may be compressed and displaced in the compressor system, thereby decreasing the compressor system capacity. In yet another example, a compressor system may include compressors that may be staged and adjusted in speed. In this example, the compressor system capacity may be total amount of refrigerant that is displaced within the compressor system as measured by both the rotational speed of the compressors and the number of compressors that are operational.

The capacity of the compressor system 26 may be adjusted in response to varying loads on the refrigeration system. For example, during periods of high load (e.g., during startup, when relatively warmer process fluid enters the evaporator 24, and/or when ambient temperatures are relatively high) the compressor system capacity may be increased to account for the elevated demand. During periods of low load (e.g., when relatively cooler process fluid enters the evaporator 24 and/or when ambient temperatures are relatively low) the compressor system capacity may be reduced to decrease the electrical power required to run the system.

According to certain embodiments, the controller 40 may determine the desired compressor system capacity based on factors related to the load on the refrigeration system, such as the temperature of the process fluid entering and/or exiting the evaporator 24, the air temperature within the building 10 (FIG. 1), and/or the compressor suction pressure, among others. For example, the controller 40 may adjust the capacity of the compressor system to maintain a fairly constant temperature of the process fluid exiting the evaporator 24. In these embodiments, a sensor 49 may be located in the process fluid line exiting the evaporator 24 to measure the temperature of the process fluid exiting the evaporator 24. The controller 40 may receive feedback from the sensor 49 and may increase and decrease the desired capacity of the compressor system in response to temperature changes detected using the sensor 49. In other embodiments, the controller 40 may employ other sensors, such as an ambient temperature sensor, an air temperature sensor within the building 10, a process fluid temperature sensor for the process fluid entering the evaporator, a process fluid temperature sensor for the process fluid flowing through the evaporator (such as sensor 60 discussed below), and/or a compressor suction pressure sensor, among others, instead of, or in addition to the sensor 49, to determine the desired compressor system capacity.

After the controller 40 has determined the desired compressor system capacity, the controller 40 may determine desired operational parameters for the compressor system 26, such as compressor rotational speed or the number or operational compressors, that should be employed to operate the compressor system 26 at the desired compressor system capacity. The controller 40 may provide input signals representing the desired operational parameters to one or more electric motors 46, which power the compressors within the compressor system 26, to set the compressor system 26 to operate at the determined compressor system capacity. By varying the compressor system capacity in response to varying loads on the refrigeration system, the refrigeration system may be operated efficiently during all phases of operation.

The controller 40 also may use the desired operational parameters for the compressor system 26 to control operation of the condenser fans 34, as described above with respect to FIG. 3. For example, the controller 40 may adjust the rotational speed of the fans 34 based on the desired rotational speed of the compressors and/or based on the desired number of operational compressors. According to certain embodiments, the controller 40 may linearly increase the speed of the fans in response to increased compressor system capacity and linearly decrease the speed of the fans in response to decreased compressor system capacity, although this relationship may not necessarily be linear. Further, in embodiments employing staged condenser fans 34, the controller 40 may adjust the number of compressor fans 34 that are operational based on the desired rotational speed of the compressors and/or based on the desired number of operational compressors.

In certain embodiments, one or more optional sensors 54, 62, 64, and 65 may be included within the refrigeration system to provide closed loop operation of the compressor system 26. In these embodiments, feedback from the sensors 54, 62, 64, and/or 65 may be employed to ensure that the compressor system 26 is operating at the desired compressor system capacity, as discussed further below. However, in other embodiments, sensors 54, 62, 64, and 65 may be omitted and the refrigeration system may be operated based on the desired compressor system capacity, as described above.

In embodiments employing the sensors 54, one or more sensors 54 may be attached to the electric motors 46 to measure the compressor system capacity. In particular, the sensors 54 may detect various parameters associated with the operation of the compressor motors 46, such as the operational state of the motors, and the rotational speed of the motors, among others. The sensors 54 may be electrically coupled to the controller 40 and may provide signals representing the detected parameters to the controller 40. It should be noted that in some implementations, the compressor system capacity may be known or estimated based upon existing and known parameters of the drive or compressor system. For example, one or more VSD's used to drive the compressors typically produce command signals, or compute or look up values for such signals, that are used as the basis for controlling solid state switches within the VSD's. Such signals or values may be used as indicators of the compressor system capacity.

Using the detected parameters, the controller 40 may determine the current operational capacity of the compressor system. For example, if the compressor system 26 includes screw-type compressors where the capacity may be adjusted by varying the rotational speed of the compressors, the sensors 54 may detect the rotational speeds of the compressors and provide the rotational speeds to the controller 40 to determine the compressor capacity. In this example, as the rotational speeds increase, compressor capacity also increases. In another example, if the compressor system 26 includes scroll-type compressors where the compressors may be staged and selectively enabled to adjust the capacity, the sensors 54 may detect the operational state of the compressor motors 46 and provide the operational states to the controller 40 to determine the compressor capacity. In this example, the more compressor motors 46 that are operational, the higher the current compressor capacity.

In certain embodiments, the controller 40 may use the current operating capacity of the compressor system 26, rather than the desired operating capacity of the compressor system 26, to adjust operation of the condenser fans 34, as described above with respect to FIG. 3. For example, the controller 40 may determine the rotational speed of the compressors and/or the number of compressors that are operational using the sensors 54. The controller may then use these measured operational parameters to adjust the speed of the condenser fans 34 and/or to adjust the number of condenser fans 34 that are operational. However, in other embodiments, the sensors 54 may be omitted and the controller 40 may adjust operation of the condenser fans 34 solely based on the desired operating capacity of the compressor system 26.

The controller 40 may adjust the rotational speed of the condenser fans and/or the number of condenser fans which are operational based on the desired or current compressor system capacity as long as the pressure of the refrigerant exiting the compressor system 26 and/or the refrigerant within the condenser coils 32 remains within a normal operating range. However, if the pressure becomes too high or too low, the controller 40 may override control of the condenser fans based on the compressor system capacity and may instead control the operation of the condenser fans based on the pressure. The pressure within the condenser coils 32 may be affected by many factors, such as the temperature of the refrigerant entering the condenser coils 32, the ambient air temperature, the rotational speed of the condenser fans, and/or the number of condenser fans that are operational, among others. Accordingly, the pressure of the condenser coils 32 may be determined using various operational inputs, which, in certain embodiments, may be measured by other sensors that are electrically coupled to the controller 40.

For example, an ambient temperature sensor 56 may be used to measure the air temperature outside of the building 10. The controller 40 may receive the ambient temperature detected by the ambient temperature sensor 56 and may use the ambient temperature either alone or with other parameters to detect a high-pressure condition within the condenser coils 32. For example, as the ambient temperature increases, less heat is transferred from the refrigerant in the condenser coils 32 to the outside air because of the reduced temperature differential. The decreased heat transfer rate may result in an increased refrigerant temperature within the condenser coils 32. As the temperature of the refrigerant increases, the pressure within the coils 32 also increases. Accordingly, the ambient temperature may be used by the controller 40 to detect a high-pressure condition within the condenser coils 32. In response to detecting a high-pressure condition, the controller 40 may override control based on compressor system capacity and may operate the fans to increase airflow through the condenser coils 32. For example, in embodiments employing condenser fans driven by VSDs, the controller 40 may increase fan speed to facilitate additional heat transfer from the refrigerant to the outside air, thereby reducing the condenser pressure. In embodiments employing fans that are staged, the controller may increase the number of fans that are operational to facilitate additional heat transfer from the refrigerant to the outside air. Further, in certain embodiments employing fans that may be staged and adjusted in speed, the controller 40 may increase the fan speed and increase the number of fans that are operational.

Instead of or in addition to an ambient temperature sensor 56, a pressure sensor 58 may be electrically coupled to the controller 40 to measure the discharge pressure of the refrigerant exiting the compressor system 26. The discharge pressure of the refrigerant exiting the compressor system 26 may affect the pressure of the refrigerant within the condenser coils 32. Accordingly, the discharge pressure detected by the pressure sensor 58 may be used by the controller 40 to detect a high-pressure condition. In other embodiments, the controller 40 may determine the discharge pressure using other operational parameters of the refrigeration system, such as the temperature within the condenser coils 32, the ambient air temperature, and/or the capacity of the compressor system, among others. In response to detecting a high-pressure condition, the controller 40 may override control based on compressor system capacity and may increase airflow through the condenser coils (e.g., by increasing fan speed and/or by increasing the number of operational fans) to reduce the condenser pressure. Further, in certain embodiments, the controller 40 also may unload the compressor 26, for example using slide valve 48, or may shut down the compressor 26 to reduce the discharge pressure.

In certain embodiments, sensors also may be employed by the controller 40 to set the capacity of the compressor system 26. For example, a temperature sensor 60 may be electronically coupled to the controller 40 to detect the temperature of the process fluid being chilled within the evaporator 24. The controller 40 may use the temperature of the process fluid to adjust the capacity of the compressor system 26 to maintain a desired temperature within the building 10 (FIG. 1). For example, when the process fluid temperature rises above a certain level, the controller 40 may increase the compressor system capacity to compensate for the temperature increase. Conversely, when the process fluid temperature decreases below a certain level, the controller 40 may reduce the compressor capacity. Accordingly, the controller 40 may set the current capacity of the compressor system 26 capacity (e.g., by varying the number of compressors in operation or by varying the rotational speed of the compressors) based on the process fluid temperature.

As the controller 40 sets the capacity of the compressor system 26, the controller 40 also may adjust the operation of the fans to correspond the current capacity setting of the compressor system 26. For example, if the controller 40 increases the compressor system capacity, the controller 40 also may increase the speed of the fans 34. If the controller 40 decreases the compressor system capacity, the controller 40 also may decrease the speed of the fans 34. In other embodiments, a separate controller (not shown) may be used to set the compressor system capacity based on the process fluid temperature. In these embodiments, the separate controller may transmit the compressor system capacity setting to the controller 40, which may then use the received setting to adjust the operation of the fans 34.

As previously discussed, the compressor unloading subsystem (e.g., slide valve 48) may affect compressor capacity. Accordingly, a sensor 62 may be electrically coupled to the controller 40 to detect when the compressor unloading subsystem is in operation. The sensor 62 may provide the controller 40 with a signal indicative of the position of the slide valve 48. Similarly, the economizer subsystem also may reduce the compressor system capacity when valves 52 and 53 are open. Therefore, sensors 64 and 65 may be attached to the valves 52 and 53, respectively to provide the controller 40 with signals indicative of the positions of the valves 52 and 53. In certain embodiments, the controller 40 may be electrically coupled to the slide valve 48 and the economizer valves 52 and 53 to control the operation of the unloading subsystem and the economizer subsystem. In these embodiments, the controller 40 sets the positions of the valves 48, 52, and 53, and the controller 40 may use these known positions in determining the current operating capacity of the compressor system 26. In these embodiments, the sensors 62, 64, and 65 may be omitted.

Although FIG. 4 depicts a single fan 34 and a single fan motor 36, these components may represent multiple fans within the condenser 14. The motor drive 38 discussed above may be electrically coupled to the controller 40. After the controller 40 has determined the fan operational settings that should be used based on the capacity of the compressor system 26, the controller 40 may adjust the operation of the fans 34 through the motor drive 38. For example, the controller 40 may provide an input signal to the motor drive 38 to enable operation of one or more of the fans 34. The controller 40 also may provide an input signal to the motor drive 38 to adjust the speed of one or more of the fan motors 36.

For closed loop operation, one or more sensors 66 may be attached to the fan motors 36 to detect the operating parameters of the fans 34. For example, the sensors 66 may measure the rotational speed of the fan motors 36. The controller 40 may then compare the detected rotational speeds to the speed settings provided to determine if the fans 34 are operating as instructed, and to make adjustments to input command signals as needed. For example, if the speed of one fan motor 36 is lower than requested, the airflow controller 40 may increase the speed of the other fan motors to provide the desired airflow over the condenser coils 32. However, in other embodiments, the sensor 66 may be omitted.

Figure 5:
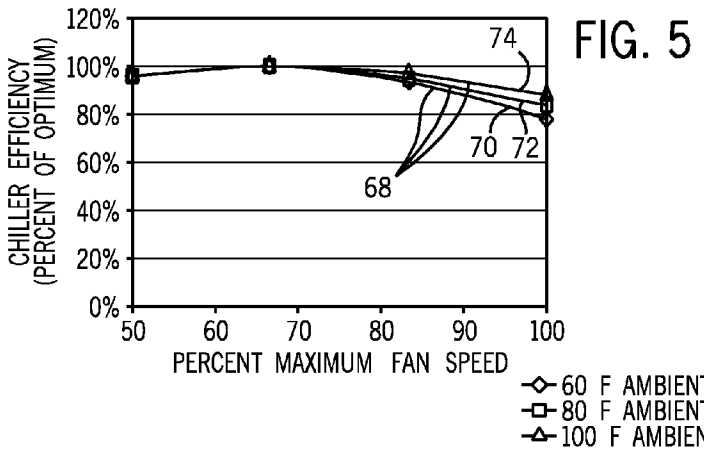
FIG. 5 is a graph of chiller efficiency verses percent maximum fan speed.

FIG. 5 is an exemplary graph of chiller efficiency verses the percent of maximum fan speed. The curves 68 represent the percent of optimal chiller efficiency over a range of fan speeds, and at constant compressor capacities. The individual curves 70, 72, and 74 represent data for the ambient temperatures of 60° F. (16° C.), 80° F. (27° C.), and 100° F. (38° C.), respectively. The apex of each of these curves 70, 72, and 74 indicates the point where the chiller efficiency is maximized. In this example, all three curves indicate that the maximum chiller efficiency occurs at the same fan speed, regardless of the ambient temperature. Thus, for a particular compressor system capacity, the ambient temperature may not materially affect the fan speed at which optimal chiller efficiency is achieved. Therefore, except when the ambient temperature is used to detect a high-pressure condition, the ambient temperature may not be a factor (or not a significant factor) employed by the controller 40 to adjust operation of the condenser fans.

Figure 6:
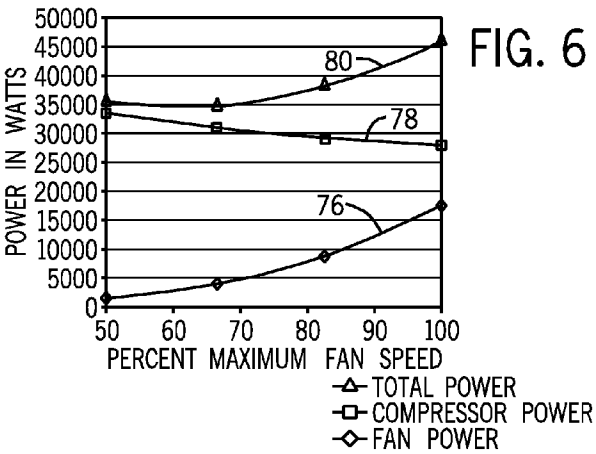
FIG. 6 is a graph of power consumption verses percent maximum fan speed.

FIG. 6 is an exemplary graph showing the power consumed by the fan motor 36 and the compressor motor 46 as a function of the percent of maximum fan speed. The curves 76, 78, and 80 are based on data that was generated for a constant compressor capacity. The curve 76 shows the power consumed by the fan motor 36 as a function of the percent of maximum speed. As the curve 76 demonstrates, the faster the fan motor 36 rotates, the more power it consumes. In addition, this relationship is commonly not linear. In other words, an increase in fan speed may result in a disproportionate increase in power consumed by the fan 34 and its drive. The curve 78 represents the power consumed by the compressor motor 46 as a function of fan speed. The curve 78 shows that as the fan speed increases, the power consumed by the compressor motor 46 decreases. This reduction in power consumption may be the result of a lower compressor head due to an increased heat transfer rate at the condenser coils 32. A lower compressor head means that the compressor expends less power to compress the refrigerant. The curve 80 represents the total power consumed by both the compressor motor 46 and the fan motor 36 as a function of fan speed. As can be seen from the curve 80, there is a point where the total power consumed is minimized. This point corresponds to the fan speed of optimal chiller efficiency as shown in FIG. 5. The fan speed at which maximum chiller efficiency is achieved may vary depending upon the compressor capacity and the refrigeration system configuration. Therefore, different refrigeration systems may have different points of optimal chiller efficiency for a given compressor capacity.

Figure 7:
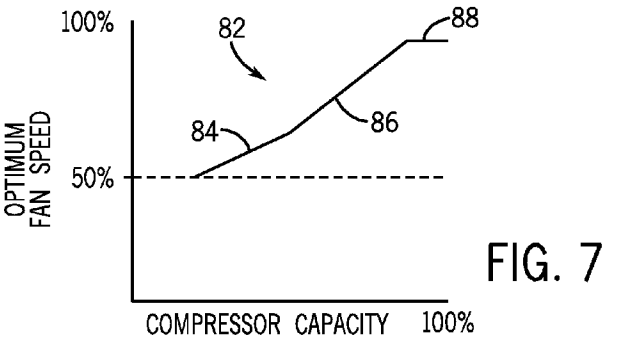
FIG. 7 is a graph of optimum fan speed verses compressor capacity.

FIG. 7 is an exemplary graph showing optimum fan speed verses compressor system capacity. The curve 82 generally demonstrates that as compressor system capacity increases, optimal fan speed also increases. As illustrated, the curve 82 begins at a fan speed of approximately 50% because minimal power is required to operate the fans 34 below this level. For example, the power consumed by the fan motor 36 at 50% speed may only be approximately 12.5% of the power consumed at 100% speed. Speeds below approximately 50% may be desirable in alternative embodiments, depending on the exact characteristics of the refrigeration system. The curve segments 84 and 86 are only exemplary segments of the curve 82. These segments are both linear, and demonstrate a slope change at a particular compressor capacity. However, the curve segments 84 and 86 may be non-linear, and additional curve segments may exist that indicate additional slope changes. The curve segment 88 represents a region where optimum fan speed remains relatively constant as a function of compressor capacity. As seen in curve 76 of FIG. 6, the power used to operate the fan motor 36 increases rapidly as the fan speed increases. Therefore, there may be a point at which the power required to increase fan speed is greater than the power required to increase compressor capacity. At that point, the optimum fan speed may remain relatively constant as a function of compressor system capacity, as seen in the curve 88.

Figure 8:
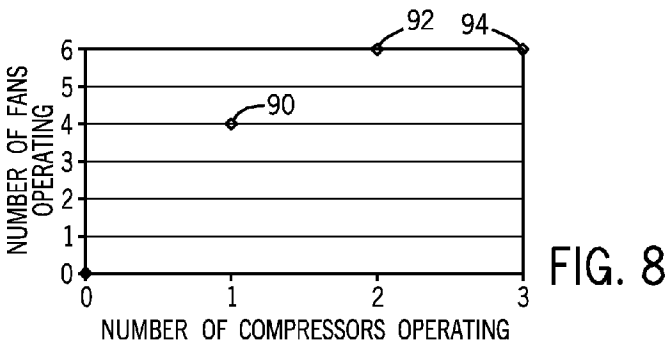
FIG. 8 is a graph of number of fans operating verses number of compressors operating.

FIG. 8 is an exemplary graph showing the number of fans that are operating verses the number of compressors that are operating. As previously discussed, compressor system configurations employing multiple scroll-type compressors may vary the compressor capacity by staging compressors. Therefore, during periods of operation requiring additional capacity, additional compressors may be activated. As the compressor capacity increases, the condensers 14 may be required to transfer additional heat to the outside air. Some condenser configurations employ single speed fans. In these configurations, airflow through the condenser coils 32 is typically increased by operating additional fans 34. For example, the data depicted in FIG. 8 is associated with a condenser 14 that has six fans 34. In a low capacity situation, one compressor may be in operation. In such a situation, optimum airflow through the condenser coils 32 may be achieved by operating four fans 34. This operating mode is illustrated as point 90 in FIG. 8. As demand on the cooling system increases, additional compressors may be operated to compensate for the additional load. Points 92 and 94 represent operational states in which two and three compressors are operated, respectively. In each of these states, all six fans 34 are operated to increase the airflow through the condenser coils 32. By increasing the number of fans 34 operating in response to increased compressor system capacity, optimal airflow through the condenser coils 32 may be achieved. As discussed above, the optimal airflow may result in increased efficiency of the entire refrigeration system. A similar arrangement may be employed for refrigeration systems that have a different number of compressors and/or a different number of fans 34. For each of these arrangements, the optimal airflow may be computed by adjusting the number of operational fans 34 as a function of the number of operating compressors.

FIG. 9 is a chart showing different operational regimes that may be used to control operation of the condenser fans as the discharge pressure of the compressor system changes. Each operational regime is defined by a region of discharge pressures, which occur between various discharge pressure levels 96, 98, 100, and 102. For most discharge pressures (e.g., those between levels 98 and 100), the condenser fans may be operated based on the capacity of the compressor system 26.

However, during high or low pressure conditions, the condenser fans may be controlled independent of the compressor capacity.

The discharge pressure of the compressor system 26 is the pressure of the refrigerant as it exits the compressor system 26 and may be measured using a sensor, such as sensor 58 shown in FIG. 4. Controller 40 may receive the discharge pressure and may then determine the appropriate operational regime that corresponds to the compressor discharge pressure. For example, when the discharge pressure is between levels 98 and 100, the controller may employ the operational regime labeled "Optimize Fan Speed for Efficiency." In this operational regime, the controller 40 may vary the fan speed based on the capacity of the compressor system, as described above with respect to FIG. 4. For example, as the capacity of the compressor system increases, the controller 40 may increase the speed of the condenser fans 40. Similarly, as the capacity of the compressor system decreases, the controller 40 may decrease the speed of the condenser fans 40. Control within this operational regime allows the airflow through the condenser coils to be varied (e.g., by adjusting condenser fan speed) based on compressor capacity to achieve optimal airflow through the condenser coils 32, which may allow the refrigeration system to be operated at maximum efficiency. Further, in embodiments employing staged fans, the number of fans which are operational may be adjusted based on the capacity of the compressor system, as described above with respect to FIG. 4, to vary the airflow through the condenser coils based on compressor capacity. In these embodiments, the number of fans that are operational may be varied based on discrete, stepped increments of compressor system capacity.

When the discharge pressure falls below level 98, the controller 40 may override control based on compressor system capacity and may employ the operational regime labeled "Reduce Fan Speed." In this operational regime, the controller 40 may reduce the fan speed to increase the discharge pressure. This reduction will be greater than the "normal" reduction that would have taken place in the efficiency optimizing regime. The increased reduction in fan speed may be reflected in a relationship between fan speed and discharge pressure (rather than a relationship between fan speed and compressor capacity, as before). The fan speed may be reduced in any suitable way with discharge pressure, such as proportionally, non-linearly, in one or more steps, and so forth. Reducing the fan speed may result in a lower heat transfer rate between the condenser refrigerant and the air, which in turn may increase the refrigerant temperature and pressure within the condenser coils 32. The higher pressure leads to a greater pressure differential between the evaporator 24 and the condenser coils 32, which may allow the compressor system 26 to continue operating, especially during periods of low refrigerant demand. Further, in embodiments employing staged fans, the controller 40 may reduce the airflow through the condenser coils 32 by decreasing the number of fans that are operational instead of, or in addition to, reducing the fan speed.

When the fan speed reduction, or decreased number of operational fans, is not sufficient to increase the discharge pressure, the discharge pressure may fall below level 96. When the discharge pressure falls below level 96, the controller 40 may employ the operational regime labeled "Low Pressure Difference Cutout." In this operational regime, the controller 40 may deactivate the compressor system 26 because the discharge pressure may not be sufficient to continue operation. For example, in compressor systems employing screw-type compressors, the discharge pressure may not be sufficient to maintain the oil seals within the compressors. Further, during periods of low demand on the chiller system, compressors may be operated at a reduced speed, which may further lower the pressure differential between the refrigerant entering and exiting the compressors. When the discharge pressure rises above level 96, the controller 40 may engage the fans and operate the fans in the "Reduce Fan Speed" operational regime. When the discharge pressure further rises above level 98, the controller may resume control of the condenser fans based on compressor system capacity using the "Optimize Fan Speed for Efficiency" regime.

When the discharge pressure rises above level 100, the controller 40 may override control based on compressor system efficiency and employ the operational regime labeled "Boost Fan Speed." In this operational regime, the controller 40 may increase the fan speed to reduce the discharge pressure. Increasing the fan speed may result in an increased heat transfer rate between the condenser refrigerant and the air, which in turn may decrease the refrigerant temperature and pressure within the condenser coils 32. If the discharge pressure drops below level 100, the controller 40 may again employ the "Optimize Fan Speed for Efficiency" regime. It should be noted that in the upper operational regime, the fan speed may, as in the lower regime, be controlled based upon a desired relationship between fan speed and discharge pressure. This, again, may be a proportional relationship, a non-linear relationship, or the fan speed may be changed in one or more steps (e.g., increased to a maximum speed). Further, in embodiments employing staged fans, the controller 40 may increase the airflow through the condenser coils 32 by increasing the number of fans that are operational instead of, or in addition to, increasing the fan speed.

However, when the increased fan speed, or increased number of operational fans, is not sufficient to reduce the discharge pressure, the discharge pressure may rise above level 102. When the discharge pressure rises above level 102, the controller 40 may employ the operational regime labeled "High-Pressure Unloading." In this operational regime, the controller 40 may interrupt operation of the compressor system 26 to protect system components.

It should also be noted that some degree of hysteresis will likely be employed in the transition between these operating regimes. This will allow for the system to remain in a current operating regime until, for example, a desired operating pressure is reached, that may be different from a pressure that prompted a change in regimes. Such approaches may avoid too frequent shifts between operational regimes.

Figure 10:
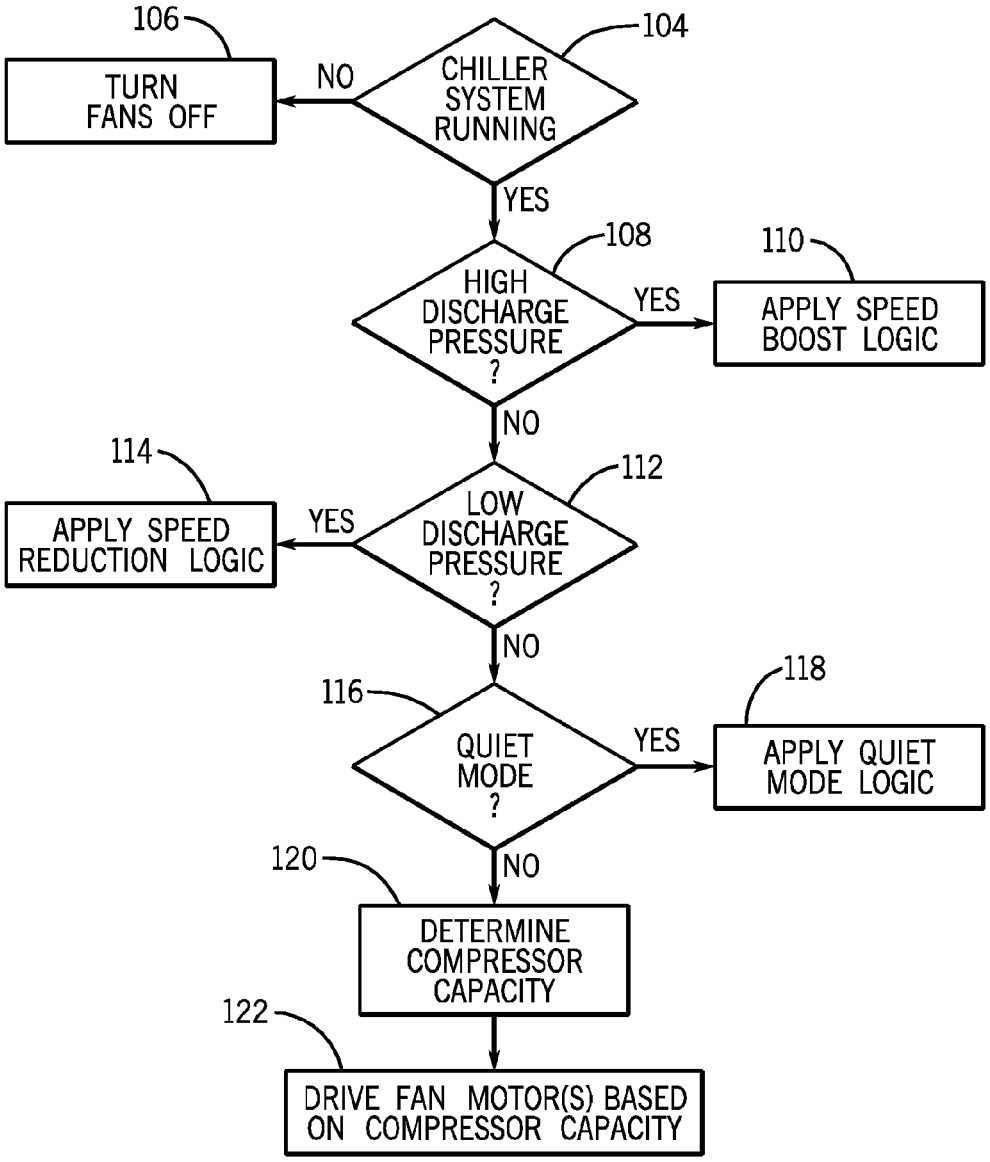
FIG. 10 is a flowchart of a method for responding to various chiller states.

FIG. 10 is a flowchart depicting an exemplary method for operating the refrigeration system. The method begins by determining (block 104) if the chiller system is running. If the chiller system is not running, the controller 40 may turn off (block 106) the condenser fans 34. If the chiller system is running, the controller 40 determines (block 108) if a high discharge pressure exists. For example, the controller 40 may receive the discharge pressure from sensor 58 as shown in FIG. 4 and may compare the detected discharge pressure to pressure level 100 as shown in FIG. 9. If the detected discharge pressure exceeds pressure level 100, the controller 40 may employ the "Boost Fan Speed" operational regime to increase the fan speed independent of the compressor system capacity. Further, if the detected discharge pressure exceeds pressure level 102, the controller may employ the "High-Pressure Unloading" operational regime to interrupt operation of the compressor system.

If the detected discharge pressure is at or below pressure level 100, the controller 40 may then determine (block 112) whether a low discharge pressure exists. For example, the controller 40 may compare the detected discharge pressure to pressure level 98 as shown in FIG. 9. If the detected discharge pressure is less than pressure level 98, the controller 40 may employ the "Reduce Fan Speed" operational regime to reduce the fan speed independent of the compressor system capacity. Further if the detected discharge pressure is below pressure level 96, the controller may employ the "Low Pressure Difference Cutout" operational regime to deactivate the compressors.

If the detected discharge pressure is at or above level 98 and at or below pressure level 100, the controller 40 may determine (block 116) whether a quiet operational mode has been activated. If the quiet operational mode is active, quiet mode logic may be applied (block 118). Quiet mode represents a sound limiting mode of operation in which maximum fan speed is limited. Fan noise decreases rapidly as fan speed is reduced. Therefore, limiting fan speed to a particular level may facilitate maintaining a low sound level. For example, local ordinances (or personal preferences) may limit the maximum decibel level emitted by equipment located on land within a particular commercial or residential zone. When quiet mode is engaged, fan speed may be limited to correspond to these maximum sound levels. Similarly, the maximum permissible sound level may be lower at night than during the day. If such an ordinance is in force within the jurisdiction where the refrigeration system is located, the system may be configured to engage quiet mode automatically at a certain time of day. Limiting fan speed reduces the heat transfer between the refrigerant in the condenser coils 32 and the outside air. The result of this limited heat transfer is warmer, higher pressure refrigerant. Higher refrigerant pressure within the condenser coils 32 means that the compressor system has to operate at a higher capacity to maintain the desired level of refrigeration, resulting in a less efficient chiller system. Therefore, it may be desirable to operate in quiet mode for the least amount of time required by the local ordinance or other factors that limit maximum sound levels.

If the chiller system is not operating in quiet mode, the controller 40 may then determine (block 120) the compressor system capacity and operate the condenser fans using the "Optimize Fan Speed for Efficiency" operational regime shown in FIG. 9. For example, the controller 40 may receive compressor rotational speed data from sensors 54 as described above with respect to FIG. 4. In another example, the controller 40 may receive data from sensors 54 that indicate how many compressors are operating in a staged compressor system. The controller 40 may use the data from sensors 54 to determine the current capacity at which the compressor system is operating.

Based on the determined compressor system capacity, the controller 40 may then determine the fan speed at which to operate the condenser fans and/or the number of condenser fans that should be operational. The controller 40 may then drive (block 122) the fan motors to achieve the determined fan speed. Several methods in which the fans 34 may be driven based on compressor capacity are presented below.

Figure 11:
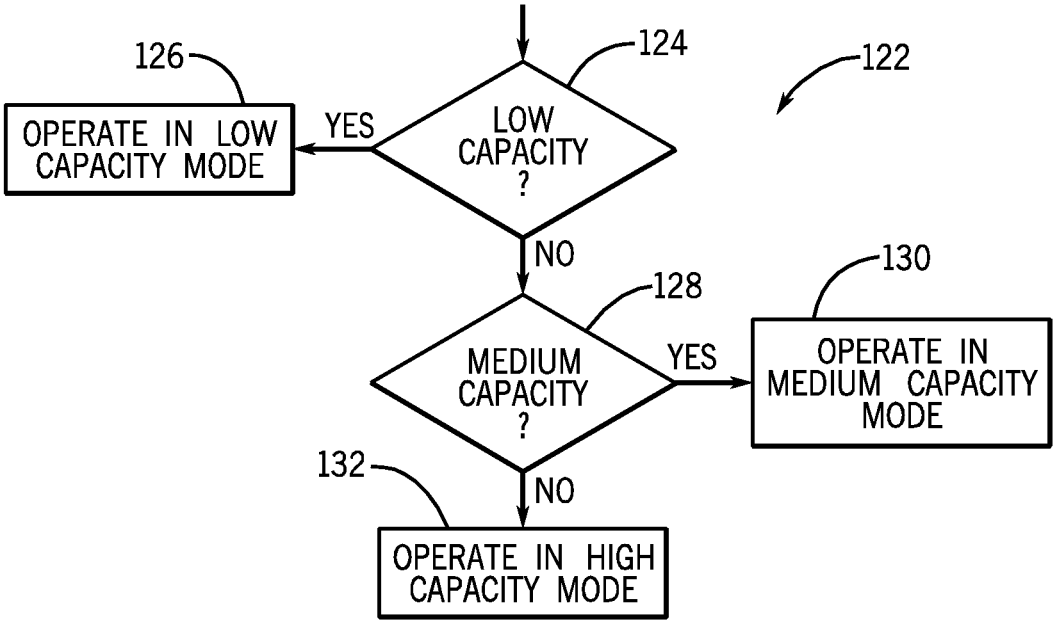
FIG. 11 is a flowchart of a method for varying fan speed in discrete increments.

For example, as depicted in FIG. 11, fan speed may be adjusted in discrete increments. Method 122 may begin by determining (block 124) if the chiller system is operating in a low capacity mode where the compressor system is operating at a low system capacity. If the chiller system is operating in a low capacity mode, fans 34 may be operated (block 126) at a speed corresponding to the low capacity of the compressor system. If the chiller system is not operating in a low capacity mode, controller 40 may determine (block 128) if the chiller system is operating in a medium capacity mode where the compressor system is operating at a medium system capacity. If the chiller system is operating in at a medium capacity mode, fans 34 may be operated (block 130) at a speed corresponding to the medium capacity of the compressor system. If the chiller system is not operating in a medium capacity mode, the controller 40 may determine that the compressor system is operating at a high system capacity. Fans 34 may then be operated (block 132) at a speed corresponding to the high capacity of the compressor system. Although only three discrete increments are shown in method 122, in other embodiments, the compressor system capacity may be divided into any number of increments specifying different levels of compressor system capacity.

Figure 12:
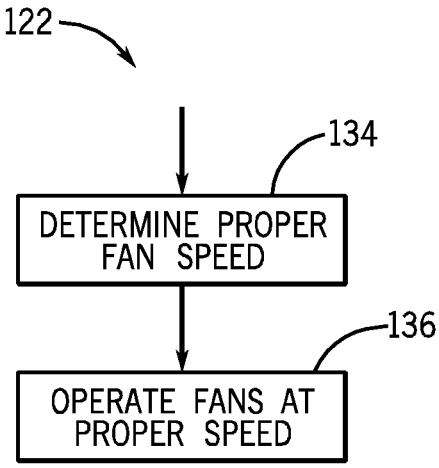
FIG. 12 is a flowchart of a method for varying fan speed.

FIG. 12 depicts another embodiment of a method 122 for varying fan speed in response to compressor system capacity. The method may begin by determining (block 134) the proper fan speed based on the determined current operating capacity of the compressor system. The fans 34 are then operated (block 136) at this speed to achieve the proper airflow through the compressor coils 32. As the detected compressor system capacity changes, the method may be repeated to continuously vary the fan speed to correspond to the current compressor system capacity.

Figure 13:
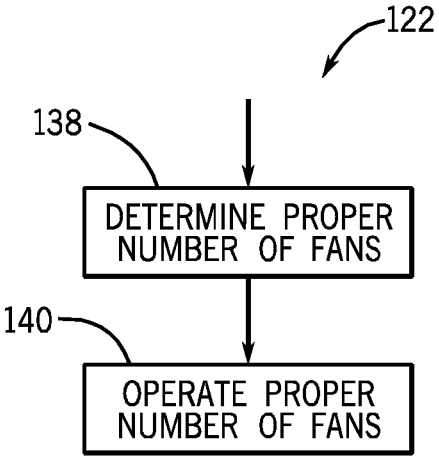
FIG. 13 is a flowchart of a method for staging fans.

FIG. 13 depicts another embodiment of a method for adjusting fan operation in response to compressor system capacity. In this method, the condenser fans 34 may be staged depending upon compressor system capacity. For example, some condensers 14 may employ multiple fans 34 to provide sufficient airflow through the condenser coils 32. In any embodiment employing multiple fans 34, airflow through the condenser coils 32 may be varied by adjusting the number of fans 34 that are running. In these embodiments, the controller 40 may determine (block 138) the proper number of fans 34 to operate based on the detected compressor system capacity. For example, as compressor system capacity increases, more fans may be operated. The proper number of fans may then be operated (block 140).

Figure 14:
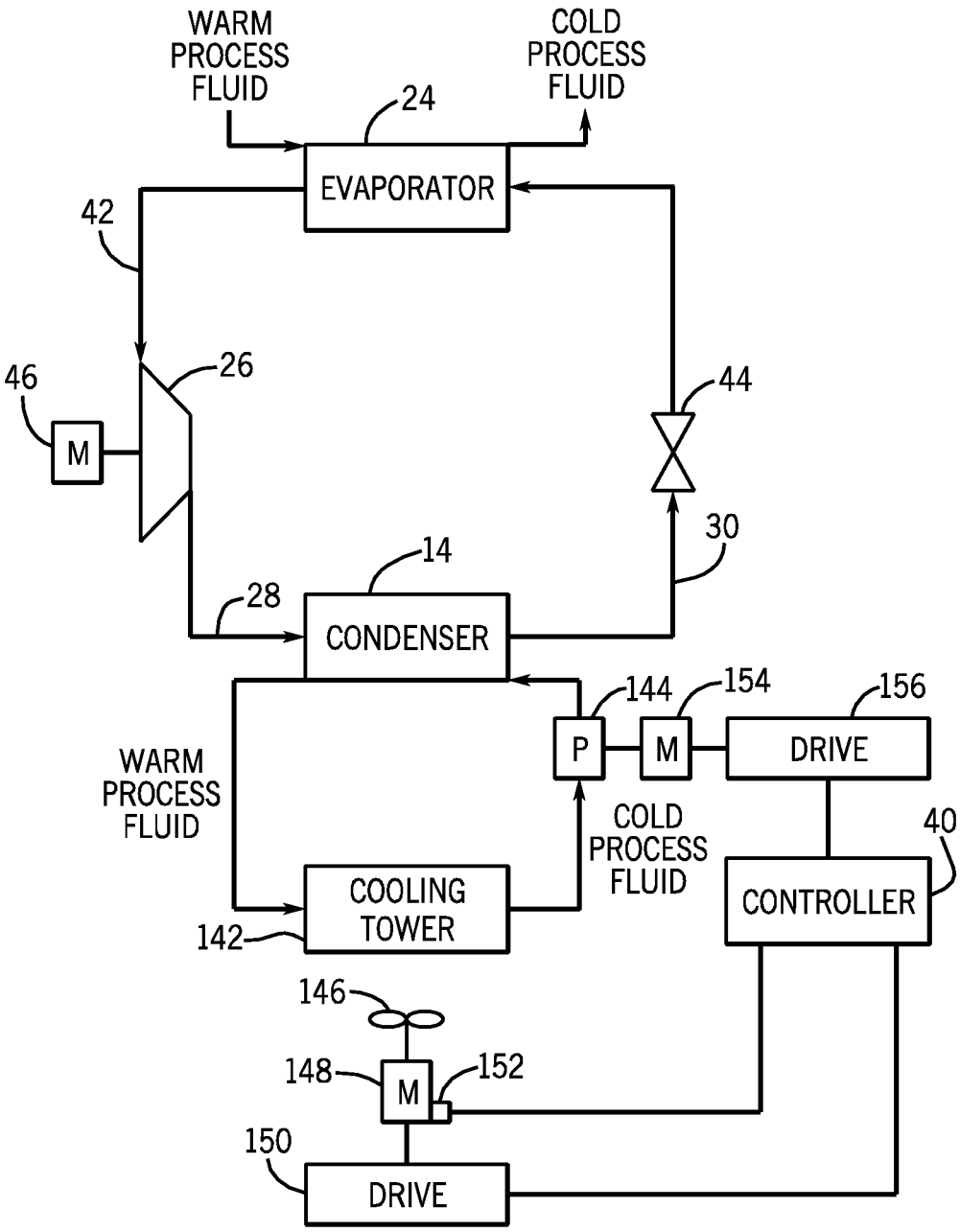
FIG. 14 is a block diagram of an exemplary embodiment of a liquid cooled refrigeration system.

FIG. 14 is a schematic diagram of an alternative embodiment of a chiller system. In this embodiment, a liquid cooled condenser is employed to cool and condense the refrigerant. As shown in FIG. 14, the process fluid temperature is reduced in a cooling tower 142, where heat is transferred from the process fluid to the surrounding air. The cooled process fluid is then pumped by a process fluid pump 144 to the condenser 14. Similar to air cooled condensers, heat from the refrigerant is transferred to the process fluid in the condenser 14. The transfer of heat cools and condenses the refrigerant, while increasing the process fluid temperature. The warm process fluid then flows back to the cooling tower 142, where the process continues. The condenser process fluid is typically water, but may include any liquid capable of removing heat from the condenser refrigerant.

To facilitate additional heat transfer from the cooling tower process fluid to the air, fans 146 may circulate air through the cooling tower 142. Similar to the previously described condenser fans 34, cooling tower fans 146 typically include fan blades, a motor 148, and a motor drive 150. These components may be representative of multiple fans 146 coupled to the cooling tower 142.

In this embodiment, the controller 40 may vary the heat absorbing capacity of the condenser process fluid based on compressor system capacity. For example, when the compressor system capacity increases, the controller 40 may increase the heat absorbing capacity of the process fluid. Increasing the heat absorbing capacity concomitantly increases the heat transfer between the condenser refrigerant and the process fluid. In other words, adjusting the process fluid heat absorbing capacity is equivalent to varying fan speed and/or varying staging in an air cooled condenser. As more heat is removed from the refrigerant, the compressor capacity required to produce a desired building air temperature decreases.

The heat absorbing capacity of the process fluid may be varied by either adjusting the temperature of the process fluid entering the condenser or by altering the process fluid flow rate. The process fluid temperature may be adjusted by varying the airflow through the cooling tower 142. For example, if the cooling tower 142 employs variable speed fans 146, increasing the speed of the fans 146 will increase the airflow through the cooling tower 142, thereby decreasing the process fluid temperature. Similarly, if the cooling tower 142 employs staged fans 146, increasing the number of fans 146 in operation will increase the airflow through the cooling tower 142. In these embodiments, the controller 40 may adjust the heat absorbing capacity of the process fluid by operating the cooling tower fans 146 based on compressor system capacity. To ensure that the fan motor 148 is operating according to instructions from the controller, a sensor 152 may be attached to the fan motor 148. The sensor 152 may measure the rotational speed of the fan motor 148, for example, and report the measured rotational speed back to the controller 40. In this manner, the controller 40 may ensure proper airflow through the cooling tower 142. For example, if the speed of one fan motor 148 is lower than requested, the controller 40 may increase the speed of other cooling tower fans 146 to compensate.

The controller 40 also may adjust the heat absorbing capacity of the process fluid by increasing the process fluid flow rate through the condenser. The controller 40 may adjust the process fluid flow rate by varying the speed of the process fluid pump 144. Similar to fans, the pump may be driven by a motor 154, and the motor 154 may be controlled by a motor drive 156. If the motor drive 156 is a VSD, the controller 40 may instruct the drive 156 to alter the speed of the motor 154 in response to varying compressor capacity. For example, if additional process fluid heat absorbing capacity is required, the controller 40 may increase the speed of the pump 144, to establish a greater process fluid flow rate. In some embodiments, the controller 40 may adjust pump speed as the sole means of controlling process fluid heat absorbing capacity. In other embodiments, the controller 40 may adjust pump speed and fan speed and/or staging to establish the desired process fluid heat absorbing capacity.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A refrigeration system comprising:

a variable capacity compressor system configured to compress refrigerant;

a condenser configured to receive and to condense the compressed refrigerant;

an expansion device configured to expand the condensed refrigerant;

an evaporator configured to evaporate the expanded refrigerant prior to returning the refrigerant to the variable capacity compressor system;

one or more fans driven by a fan drive and configured to displace air over the condenser;

a means for determining a discharge pressure of the variable capacity compressor system; and a controller operatively coupled to the fan drive and configured to:

regulate the fan drive based on an operational capacity of the variable capacity compressor system when the discharge pressure is within a range defined by a first level and a second level, regulate the fan drive based on the discharge pressure when the discharge pressure is below the first level or above the second level, reduce fan speed of the fan drive based on the discharge pressure when the discharge pressure is below the first level, deactivate the variable capacity compressor system when the discharge pressure is below a third level, wherein the third level is below the first level, increase fan speed of the fan drive when the discharge pressure is above the second level, and interrupt operation of the variable capacity compressor system when the discharge pressure is above a fourth level, wherein the fourth level is above the second level.

2. The refrigeration system of claim 1, wherein the means for determining a discharge pressure comprises a pressure sensor configured to detect the discharge pressure.

3. The refrigeration system of claim 1, wherein the operational capacity comprises a total operational displacement rate of refrigerant through the compressor system.

4. The refrigeration system of claim 1, wherein the controller is configured to regulate the fan drive independent of the operational capacity when the discharge pressure is below the first level or above the second level.

5. The refrigeration system of claim 1, wherein the operational capacity represents a desired operational capacity, and wherein the controller is configured to determine the desired operational capacity based on a load on the refrigeration system.

6. The refrigeration system of claim 5, wherein the controller is configured to adjust operation of the variable capacity compressor system to operate the variable capacity compressor system at the desired operational capacity.

7. The refrigeration system of claim 1, comprising another controller configured to determine the operational capacity based on a load on the refrigeration system and to provide the operational capacity to the controller operatively coupled to fan drive.

8. The refrigeration system of claim 1, comprising one or more sensors configured to measure operational parameters of the variable capacity compressor system, wherein the controller is configured to determine the operational capacity using the measured operational parameters.

9. The refrigeration system of claim 1, wherein the measured operational parameters comprise a compressor rotational speed, or a number of operational compressors, or a combination thereof.

10. A refrigeration system comprising:

a variable capacity compressor system of one or more variable speed compressors configured to compress refrigerant;

a condenser configured to receive and to condense the compressed refrigerant;

an expansion device configured to expand the condensed refrigerant;

an evaporator configured to evaporate the expanded refrigerant prior to returning the refrigerant to the variable capacity compressor system;

one or more fans driven by a fan drive and configured to displace air over the condenser;

a means for determining a discharge pressure of the variable capacity compressor system; and a controller operatively coupled to fan drive and configured to:

regulate the fan drive based on a rotational speed of the one or more variable speed compressors when the discharge pressure is within a range defined by a first level and a second level, regulate the fan drive based on the discharge pressure when the discharge pressure is below the first level or above the second level, reduce fan speed based on the discharge pressure when the discharge pressure is below the first level, deactivate the variable capacity compressor system when the discharge pressure is below a third level, wherein the third level is below the first level, increase fan speed when the discharge pressure is above the second level, and interrupt operation of the variable capacity compressor system when the discharge pressure is above a fourth level, wherein the fourth level is above the second level.

11. The refrigeration system of claim 10, wherein the controller is configured to regulate the fan drive to drive the one or more fans at speeds that are proportional to the rotational speed of the one or more compressors.

12. The refrigeration system of claim 10, wherein the controller is configured to regulate the fan drive by varying fan speed of the one or more fans.

13. The refrigeration system of claim 10, comprising two or more fans, wherein the controller is configured to regulate the fan drive by selectively enabling and disabling operation of the two or more fans.

14. The refrigeration system of claim 10, wherein the rotational speed represents a desired rotational speed, and wherein the controller is configured to determine the desired rotational speed based on a load on the refrigeration system.

15. A method of operating a refrigeration system, the method comprising:

determining an operational capacity of a compressor system;

determining a discharge pressure of the compressor system;

controlling operation of one or more condenser fans based on the operational capacity when the discharge pressure is within a range defined by a first level and a second level;

controlling operation of the one or more condenser fans based on the discharge pressure when the discharge pressure is below the first level or above the second level, increasing a fan speed of the one or more condenser fans when the discharge pressure is above the second level;

decreasing the fan speed of the one or more condenser fans when the discharge pressure is below the first level;

deactivating the compressor system when the discharge pressure is below a third level, wherein the third level is below the first level; and interrupting operation of the compressor system when the discharge pressure is above a fourth level, wherein the fourth level is above the second level.

16. The method of claim 15, wherein determining an operational capacity comprises determining a desired operational capacity based on a load on the refrigeration system.

17. The method of claim 16, wherein determining a desired operational capacity comprises determining a rotational compressor speed for producing the desired operational capacity.

18. The method of claim 16, wherein determining a desired operational capacity comprises determining an operational number of compressors for producing the desired operational capacity.

19. The method of claim 15, wherein controlling operation of one or more condenser fans based on the operational capacity when the discharge pressure is within a range defined by a first level and a second level comprises linearly varying a fan speed based on a rotational speed of one or more compressors within the compressor system.

* * * * *